United States Patent [19]

Urie et al.

[11] 4,344,481

[45] Aug. 17, 1982

[54] COUNTERFLOW HEAT EXCHANGER CONSTRUCTION

[75] Inventors: Robert G. Urie, Hartford, Conn.; John F. Kowinski, Springfield, Mass.

[73] Assignee: United Technologies Corporation, Hartford, Conn.

[21] Appl. No.: 114,470

[22] Filed: Jan. 23, 1980

[51] Int. Cl.[3] ..... F28F 9/02

[52] U.S. Cl. ..... 165/166

[58] Field of Search ..... 165/165, 166; 60/39-51

[56] References Cited

U.S. PATENT DOCUMENTS

| | | | |
|---|---|---|---|
| 2,703,700 | 3/1955 | Simbelaur | 165/165 |
| 3,860,065 | 1/1975 | Schauls | 165/166 |

*Primary Examiner*—Samuel Scott
*Assistant Examiner*—Theophil W. Streule, Jr.
*Attorney, Agent, or Firm*—Robert E. Greenstien

[57] ABSTRACT

In a counterflow heat exchanger a manifold is attached at two points to the ram and bleed closure bars. The bleed closure bar defines a bleed inlet from the manifold and is constructed to reduce the mechanical stresses in the ram closure bar between those attachment points.

3 Claims, 3 Drawing Figures

FIG. 1
PRIOR ART
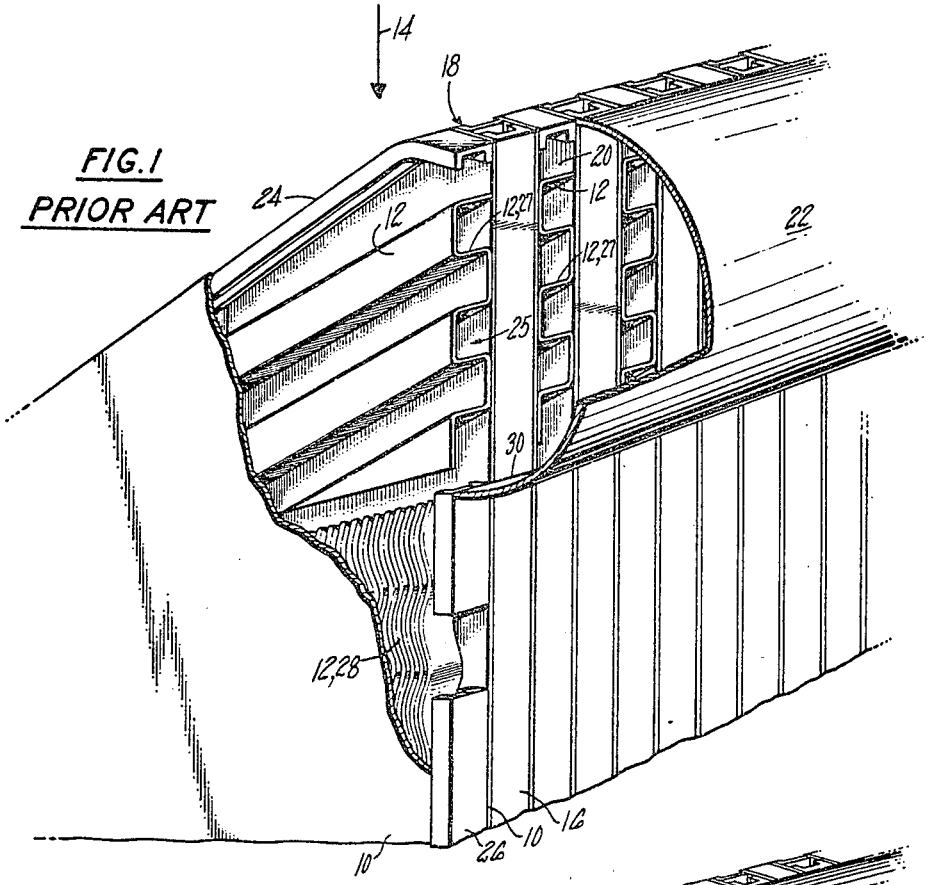
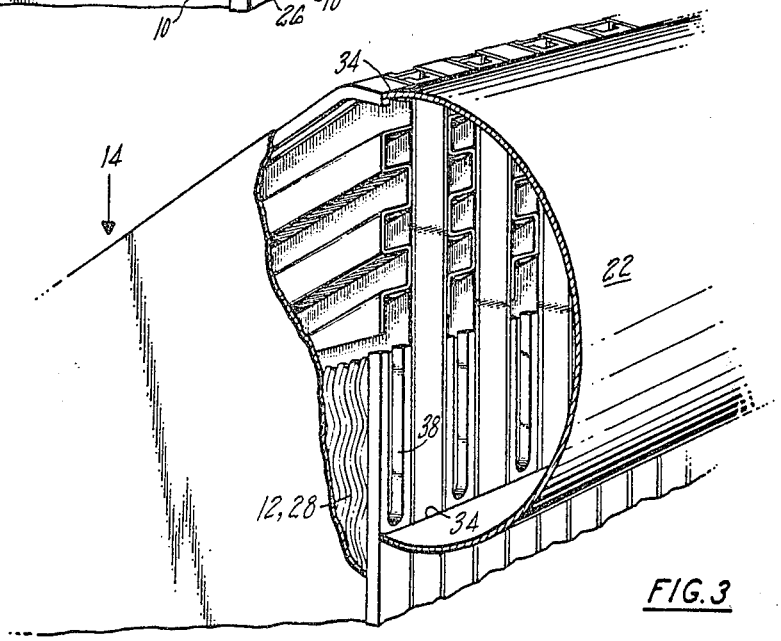
FIG. 3

COUNTERFLOW HEAT EXCHANGER CONSTRUCTION

DESCRIPTION

1. Technical Field

This invention relates to the construction of counterflow heat exchangers which are frequently employed in gas turbine powered air-conditioning systems.

2. Background Art

The typical air-conditioner counterflow heat exchanger consists of a stack of brazed, thermally interconductive air flow sections or layers. Hot air and cold air are forced through alternate layers in order to interchange heat. In a gas turbine air-conditioning system that hot air comes from the engine bleed and flows through bleed layers. The cold air on the other hand is outside air and flows through the ram layers. These alternatively stacked ram and bleed layers are joined together along a thermally conductive medium, called the parting sheet and heat from the bleed layers is transmitted through the parting sheets to the ram air flow. A counterflow heat exchanger is so named simply because the two flows are basically opposite in direction to each other: the bleed air flow enters through one side of the exchanger and its flow direction is changed by use of miter shaped fin details so its flow direction is opposite that of the ram air. The ram air flow enters through an adjacent side.

The ram and bleed layers are fundamentally the same: each consists of an array of cooling fins and frames or closure bars which are positioned on the parting sheets defining each layer. Frames or closure bars are placed along the edges of the layers to support the ends of the parting sheets. In addition to supporting the ends of the parting sheets, these bars close off each layer, except where there is an air inlet and an air outlet. At the air inlets and outlets the fins provide support for the parting sheets.

To fabricate the heat exchanger, the ram and bleed layers are stacked alternately one on top of another and then placed in a vacuum furnace for brazing. During the brazing process the stack is squeezed so as to force the layers together. The brazing is complete when the fins are brazed to the parting sheets and the edges of the sheets are uniformly brazed along the closure bars. The bleed and ram air flows are supplied from corresponding manifolds that are subsequently welded to the closure bars. The manifolds extend across the heat exchanger, generally normal to the layers.

By reason of their size, nine cubic feet, for example, and their function, counterflow air-conditioning heat exchangers are susceptible to not insignificant thermal stresses when they warm up and cool down. These stresses occur when the bleed air flow is started and stopped. During these heating and cooling cycles of the exchanger the core expands and contracts more rapidly than the manifolds. During this same time the manifolds heat and cool down differently than the layers. This causes significant stress in the ram bar in its region or position between its attachment points to the bleed manifold. That portion of the ram closure bar defines a guided cantilever beam and the expansion and contraction forces are distributed along the length of this beam. However, the manifold attached thereto does not expand and contract the same as the heat exchanger and as a result, the portion between the attachment points flex or bend in one direction as the core warms up and in the opposite direction when it cools down. Thus throughout the useful life of the heat exchanger the ram closure bars are cyclically stressed and this cyclic stress, from the flexing, may produce cracks in the parting sheets and ram closure bars and fatigue the braze between the bars and the parting sheets. These stresses are greatest in those ram layers that are furthest from the mid point of the exchanger core since the expansion and contraction movement is greatest in that area of the heat exchanger. Therefore, the outermost ram closure bars tend to be the first to show the signs of fatigue caused by repeated thermal flexing. The useful service life of the exchanger as well as its efficiency are effected by these stresses because they can crack the bars and thereby cause the bars and sheets to separate which causes deteriorated flow containment that gets progressively worse. In addition, any separation may weaken the exchanger structure, thereby increasing the stresses and possibly accelerating the deterioration process.

DISCLOSURE OF INVENTION

The stress developed in the ram closure bar portions between the manifold attachment points can be reduced significantly by lengthening those portions, merely by moving the attachment points further apart. This increases the size of the bleed air inlet and outlet manifolds. However, increasing the distance between the attachment points is not entirely enough to limit the stresses on the closure bars; it is also necessary to reduce the length of the adjacently brazed bleed closure bar which defines the air inlet and outlet on the adjacent bleed layers. The reason is that the adjacent bleed closure bars also support the ram closure bars and, hence, unless they are shortened, the length of the ram closure section between the attachment point is not actually lengthened. Thus it is necessary to provide less support between the parting sheets at that region but, nonetheless, provide sufficient support so that uniform contact is made between the outer edges and the parting sheets for fabrication (when the layers are stacked and pushed together) in order to ensure that the edges are uniformly brazed, so that there are no air leaks between the layers. Hence, it is necessary to provide sufficient support between the parting sheets for proper fabrication, but also to avoid unacceptable stresses on the ram closure bars. In other words, the support must be less than that provided by the rigid but now shortened bleed closure bars, but there must be sufficient support to allow for fabrication in the usual manner.

In accordance with the instant invention the size of the bleed inlet and outlet manifolds are increased to increase the space between the attachment points, thereby increasing the length of the closure bar section between those points and over which the expansion and contraction stresses appear. The support provided along the edge of the parting sheets and between the manifold attachment points on the bleed layers is reduced so that as the exchanger expands and contracts the stresses on the parting sheets and ram closure bars are reduced. Sufficient support is provided, however, to hold the sheets against the closure bars and the fins during the fabrication process. According to the invention one way to do this is to put stress relieving slots in the bleed closure bars. These slots extend from that end of the bars that defines one side of the bleed inlet to the manifold attachment point. An alternative is to extend the outermost bleed counterflow fin outward to the edge of the parting sheet; that fin is normally located inward from the edge and is separated from it by the bar. By doing this the same outer flow boundary is provided along the parting sheet edge but with dramatically less rigidity. Therefore, the parting sheets are supported by the counterflow fin which is capable of flexing as the heat exchanger expands and contracts, yet without applying substantial stresses to the ram closure bar that is attached at the opposite side of the parting sheet that separates them. Nevertheless, the fin is rigid enough so that no change in the assembly technique is required.

The present invention consequently provides an exchanger construction by which the ram closure bar attachment points may be moved further apart to increase the beam length therebetween; the bleed closure bar support may be decreased and, yet, proper support is supplied along the outer edge of the parting sheet, and thus no change in the fabrication process is required.

BRIEF DESCRIPTION OF DRAWINGS

FIG. 1 is a perspective view, partially cut away, of a portion of a prior art counterflow heat exchanger;

FIG. 3 is a perspective view, partially cut away, of a portion of a counterflow heat exchanger embodying a second embodiment of the present invention.

BEST MODE FOR CARRYING OUT THE INVENTION

Figure 2:
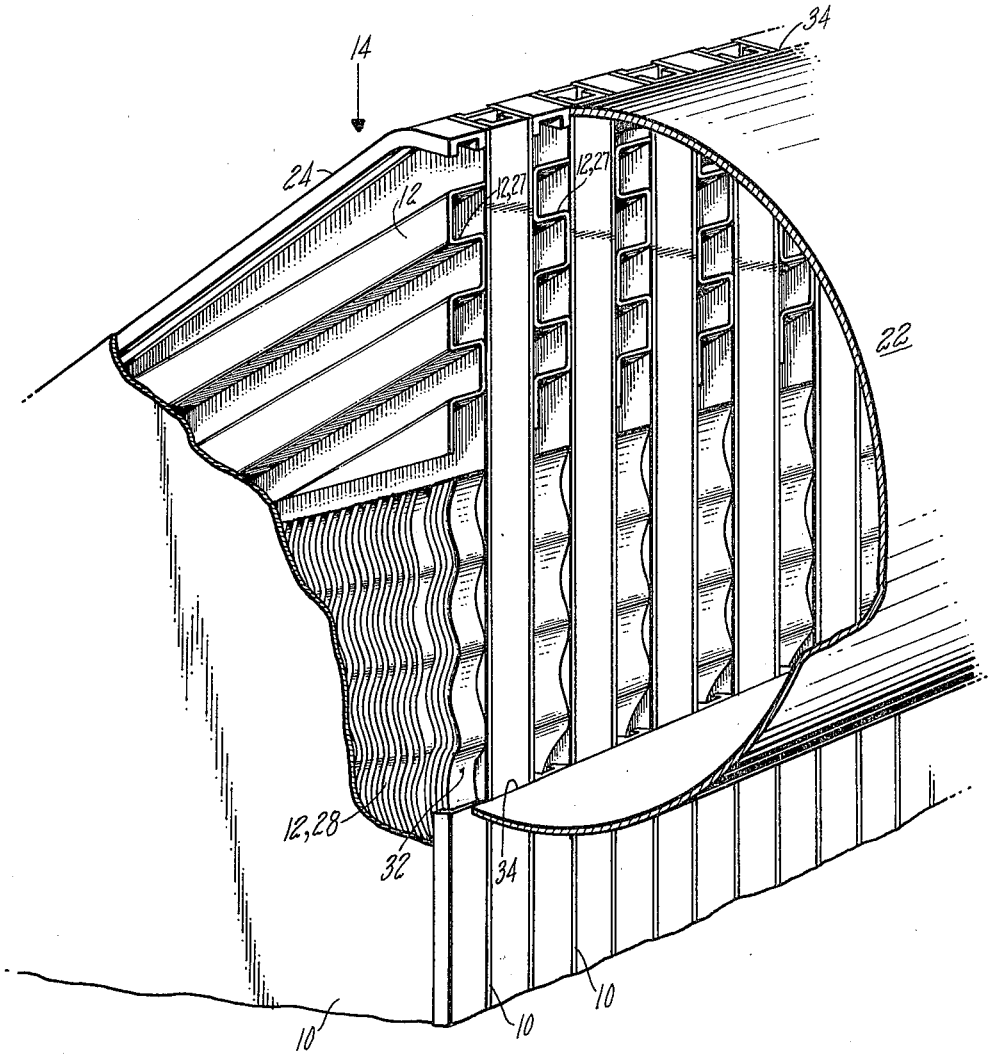
FIG. 2 is a perspective view, partially cut away, of a portion showing a counterflow heat exchanger embodying one embodiment of the present invention.

FIG. 1 shows a portion of a prior art counterflow heat exchanger consisting of a plurality of layers that are defined by parting sheets 10 and cooling fins 12 that are located between the sheets. Cold or ram air is forced through the upper portion of the heat exchanger in the direction of the arrow 14 and flows through the ram air layers 18 which are not visible in FIG. 1 because these layers have a closure bar 16 which completely closes off their edge. The ram air layers 18 are located between hot air or bleed layers 20 which receive the hot air through a manifold 22. The hot air flows from the manifold into the bleed layers 20 through an inlet that is defined between the end of a bleed closure bar 24 and a bleed closure bar 26. The bleed closure bar 24, like the ram closure bar 16, functions to completely seal off the bleed layer with respect to the ram flow in the direction of the arrow 14.

As stated previously, a heat exchanger of this type is fabricated by stacking the parting sheets with the closure bars and the cooling fins in place. Weight is then applied to the layers so as to squeeze them together, and the assembly, consisting of the layers so held together, is then placed in a vacuum furnace where it is heated to a temperature at which the parting sheets become brazed to the closure bars and the cooling fins. The manifold is then attached to the closure bars at attachment points 30, as shown in FIG. 1.

The closure bars are generally C-shaped and substantially more rigid than the individual cooling fins 12. These fins are arranged in a counterflow pattern so that as air enters the bleed layers, in the direction of the arrow 25, it passes through miter fins 27 which direct the flow downward into a larger number, more tightly packed arrangement of fins 28. Obviously, fins 27 tend to be hotter than the fins 28 because as the flow passes between the two, it is cooled by the ram flow in the arm layer. Heat transfer takes place through the parting sheets that separate the layers.

As the hot air is applied to the heat exchanger through the manifold 22, significant expansion begins in the manifold and the heat exchanger. The reverse occurs when the hot air flow is turned off. The expansion and contraction in the exchanger is greatest in the layers that are furthest from the center of the heat exchanger. The result of this is that stresses are set up in the ram closure bars 16 between the attachment points 30 and these stresses cause the ram closure bars to bend or flex between the attachment points 30. Hence, each cycle comprising heating and cooling produces significant stresses along the attachment point between the ram closure bar and the parting sheets between the attachment points 30 and eventually fatigue occurs: a break appears between and in the parting sheets and the ram closure bars; this break permits mixing of the ram and hot air flow. It is unsatisfactory because it deteriorates heat exchanger efficiency and only grows worse with subsequent cycles.

FIGS. 2 and 3 each show an embodiment of the present invention which focuses principally upon increasing the distance between the manifold attachment points 30 so as to distribute the dimensional changes between the attachment points 30 over a longer distance and thereby decrease the overall stress in the ram bars between those points. Merely increasing distance between the manifold attachment points in the heat exchanger in FIG. 1 would not provide satisfactory results because mechanically the layers would still be attached to the same points by reason of their mutual attachment to the parting sheets between them.

FIG. 2 demonstrates one way, according to the present invention, to increase the size of the opening between the manifold attachment points and, at the same time, provide satisfactory support between the layers to permit normal fabrication of the exchanger. The principal difference between the heat exchanger in FIG. 2 and that shown in FIG. 1 is that the hot air closure bar is shortened to allow for a greater distance between the manifold attachment points, but one of the counterflow fins 32 has been extended outward to be located along the edge of the parting sheet and there it provides support along the edge and a boundary for the hot air flow in the manifold 22 which is thus directed, as in FIG. 1, only to the fins 27. Thus the manifold attachment points are located further apart and the air flow pattern remains the same. The fins are significantly softer (more pliant), however, than the closure bars and thus provide some degree of resiliency or movement between the parting sheets 10 which can thus conform, so to speak, to any changes (curving-bending) in the linearity of the ram closure bar between the attachment points 34. In other words, in contrast with FIG. 1, in the bleed layers the entire support between the parting sheets between the manifold attachment points 34 is provided by the cooling fins which have more give than the closure bars and thus allow the sheets to flex slightly to conform to any changes in the ram closure bar shape, which is reduced because the beam length is now increased. Nevertheless, the fins do provide sufficient support along the edges of the closure bars so that when weight is applied to the sheets during fabrication, the edges of the sheets and the closure bars are uniformly and securely pushed together.

The second embodiment, shown in FIG. 3, provides a slot or cut in the bleed air closure bar. The effect of this slot is also to reduce the overall intersheet stiffness of the bleed closure bar in the region where the slot is located, to allow for the sheets to conform to any changes that occur in the linearity of the ram closure bar between the attachment points 34. This slot, however, does not provide the necessary support for brazed fabrication and must be cut into the closure bar following braze.

The result achieved by both embodiments is that the strain in the ram closure bar between the attachment points 34 is reduced significantly (typically by 4:1).

The foregoing is a description of the best mode for carrying out the invention, and it may suggest, to one skilled in the art, numerous modifications, variations and alterations in and to the embodiments shown, yet without departing from the true scope and spirit of the invention embodied therein and as set forth in the claims that follow.

We claim:

1. A heat exchanger comprising:

a stack of air flow layers, each layer containing an arrangement of cooling fins;

rigid closure bars associated with each layer for containing air flow within the layer;

a manifold which is attached to the closure bars on one side of the stack, through which air is directed to the layers and which spans each layer for a distance D; and characterized in that:

on one of the layers the manifold is attached to a closure bar that completely closes off access to the layer from the manifold;

in second and third layers adjacent said first layer there is an arrangement of thin cooling fins for directing air flow from the manifold through the layer and a second closure bar, to which the manifold is attached, to define a first opening to the layer from the manifold; and said arrangement comprises at least one pliant, thin ribbon-like serpentine fin that extends along the edge of the layer from the point at which the second closure bar is attached to the manifold to define, within said first opening, a second smaller opening to the other fins in the arrangement.

2. A heat exchanger according to claim 1, characterized in that:

said arrangement of fins includes a first set of fins and a second set of fins;

said first set receives substantially all flow from the manifold through said second opening and oriented within the layer to direct the flow to the second set of fins, the air flow through said second set being about 90° relative to the flow through said first set; and said second set includes said one fin and consists of ribbon-like, serpentine fins.

3. A heat exchanger comprising:

a stack of air flow layers, each layer containing an arrangement of cooling fins;

rigid closure bars associated with each layer for containing air flow within the layer;

a manifold which is attached to the closure bars on one side of the stack, through which air is directed to the layers and which spans each layer; and characterized in that:

on one of the layers the manifold is attached to a closure bar that completely closes off access to the layer from the manifold;

in second and third layers adjacent said first layer there is an arrangement of thin cooling fins for directing air flow from the manifold through the layer and a second closure bar, to which the manifold is attached, to define a first opening to the layer from the manifold;

said arrangement comprises at least one pliant, thin ribbon-like serpentine fin that extends along the edge of the layer from the point at which the second closure bar is attached to the manifold to define, within said first opening, a second smaller opening to the other fins in the arrangement; said second closure bar includes a slotted portion which extends from the manifold attachment point partially along the first opening, the two sides of the slotted portion being attached to opposite layers in the stack.

* * * * *